US009993682B2

(12) United States Patent
Johnson et al.

(10) Patent No.: US 9,993,682 B2
(45) Date of Patent: Jun. 12, 2018

(54) STAIR EXERCISER APPARATUS

(71) Applicants: Noel R Johnson, Stoughton, WI (US); Alexander E Hanson, Sun Prairie, WI (US)

(72) Inventors: Noel R Johnson, Stoughton, WI (US); Alexander E Hanson, Sun Prairie, WI (US)

(73) Assignee: Johnson Health Tech Co., Ltd., Taichung (TW)

( * ) Notice: Subject to any disclaimer, the term of this patent is extended or adjusted under 35 U.S.C. 154(b) by 0 days. days.

(21) Appl. No.: 15/135,556

(22) Filed: Apr. 22, 2016

(65) Prior Publication Data

US 2017/0304674 A1 Oct. 26, 2017

(51) Int. Cl.
*A63B 22/04* (2006.01)
*A63B 21/00* (2006.01)

(52) U.S. Cl.
CPC ..... *A63B 22/04* (2013.01); *A63B 21/00192* (2013.01)

(58) Field of Classification Search
CPC ... A63B 22/04; A63B 21/005; A63B 21/0056; A63B 21/015; A63B 21/00192; A63B 21/225
See application file for complete search history.

(56) References Cited

U.S. PATENT DOCUMENTS 4,927,136 A 5/1990 Leask
5,180,351 A * 1/1993 Ehrenfried ..... A63B 21/154 482/51
8,702,571 B2 4/2014 Fenster et al.
2010/0062903 A1* 3/2010 Lin ..... A63B 21/00192 482/2
2012/0264572 A1* 10/2012 Fenster ..... A63B 22/04 482/52

* cited by examiner

*Primary Examiner* — Loan H Thanh
*Assistant Examiner* — Jennifer M Deichl

(57) ABSTRACT

A stair exerciser apparatus includes a frame having a pair of inclined supports, a drive mechanism, a plurality of stairs and an electromagnetic resistance device. The stairs are coupled to the drive mechanism for traveling around the pair of inclined supports. The electromagnetic resistance device is coupled to the drive mechanism to control the running speed of the stairs. The electromagnetic resistance device has a flywheel, an electromagnet and a brake unit. The electromagnet is coupled to the brake unit for controlling rotation resistance of the flywheel. The brake unit has a brake block for stopping the flywheel to stop the stairs. The brake unit is pivotally rotatable between a non-braking position where the brake block is pulled away from the flywheel when the electromagnet is energized and a braking position where the brake block is pulled to stop the flywheel when the electromagnet is loss of power.

10 Claims, 6 Drawing Sheets

STAIR EXERCISER APPARATUS

BACKGROUND

1. Field of the Invention

The present invention relates to an exercise apparatus. More particularly, the present invention relates to a stair exerciser apparatus for simulating stair climbing.

2. Description of the Related Art

In general, the stair exerciser apparatus is driven downward by an external load such as the weight of an operator standing upon the stairs. The downward running speed of the stairs is generally controlled by a braking mechanism. The braking mechanism may be an eddy current brake (ECB), a friction brake, or any other brake that is known in the art. For example, U.S. Pat. No. 4,927,136 discloses an electromagnetic brake that is utilized in the control of exercise equipment including escalator type stair-climbing apparatus, in which electronically controllable torque, including a clamping torque, is applied to a rotary shaft to load the exercise equipment, thereby giving complete electronic control to the operation of the exercise apparatus. Another type of stair exerciser apparatus illustrated in U.S. Pat. No. 8,702,571 discloses a braking mechanism disposed next to a flywheel. The braking mechanism is controlled by control signals sent by a controller. The braking mechanism is adjustable so that the amount of braking force may be increased or decreased by the controller. As the flywheel rotates, the braking mechanism provides an opposing torque to the flywheel, thereby slowing down the rotation of the flywheel and the speed of the steps.

The braking mechanism of the conventional stair exerciser apparatus is generally actuated by means of electronic control, namely, the resistance of the braking mechanism is controlled by a controller. However, if the stair exerciser apparatus were to lose power, the braking mechanism may be broken down such that the stairs of the stair exerciser apparatus may be out of control. In order to prevent the occurrence, the safety device is important to stop the stairs immediately.

The present invention has arisen to mitigate and/or obviate the disadvantages of the conventional stair exerciser apparatus. Further benefits and advantages of the present invention will become apparent after a careful reading of the detailed description with appropriate reference to the accompanying drawings.

SUMMARY

The object of the present invention provides a stair exerciser apparatus with safety mechanism to ensure the safety of users during exercise.

According to one aspect of the present invention, the stair exerciser apparatus includes a frame, a drive mechanism, a plurality of stairs, and a resistance mechanism. The frame has a pair of inclined supports slanted downward from a front end to a rear end of the frame. The drive mechanism has an upper shaft rotatably mounted to the frame at an upper portion of the pair of inclined supports, a lower shaft rotatably mounted to the frame at a lower portion of the pair of inclined supports, and a pair of drive chains mounted around the upper shaft and the lower shaft for revolving circularly around the pair of inclined supports. The stairs are coupled to the pair of drive chains for being synchronously revolved around the pair of inclined supports. The resistance mechanism is coupled to the upper shaft of the drive mechanism to control the rotational resistance of the upper shaft and thereby to control the downward running speed of the stairs. The resistance mechanism includes an electromagnetic resistance device having a flywheel, an electromagnet and a brake unit. The electromagnet is coupled to the brake unit and disposed next to the flywheel for electronically controlling the rotational resistance of the flywheel. The brake unit has a brake block for stopping the flywheel so as to stop the stairs. Specifically, the brake unit is pivotally rotatable between a non-braking position where the brake block is pulled away from the flywheel when the electromagnet is energized and a braking position where the brake block is pulled to stop the flywheel when the electromagnet is loss of power.

Preferably, the brake unit is moved forward to the non-braking position by magnetic attraction between the electromagnet and the flywheel. The electromagnetic resistance device has a spring connected to the brake unit for normally biasing the brake unit backward to the braking position. The electromagnetic resistance device has two spaced apart retaining plates secured to the frame. The flywheel is rotatably sandwiched between the two opposite retaining plates, and the brake unit is pivotally mounted about a pivot pin connected between the two retaining plates such that the brake unit is rotatable between the non-braking position and the braking position.

Preferably, the brake unit has a post defined at a lower portion opposite to the pivot pin, the spring having one end secured to the post and the other end anchored to the two retaining plates for pulling the brake unit backward to the braking position.

Preferably, at least one of the retaining plates has a slot for receiving the post of the brake unit to restrict the rotation angle of the brake unit between the non-braking position and the braking position.

Preferably, a screw is secured to a tab which is protruded from the corresponding retaining plate to retain the post projected from the corresponding retaining plate through slot for restricting a gap between the electromagnet and the flywheel.

Preferably, the brake unit has two side plates spaced a distance apart, and the electromagnet is sandwiched in between the two side plates. The brake block is pivotally mounted between the two side plates at the upper portion toward the flywheel, and the post extends through the two side plates at the lower portion opposite to the pivot pin.

Preferably, the stair exerciser apparatus had a pulley coupled to the upper shaft and a belt connecting the pulley and a central shaft of the flywheel, rotation of the upper shaft causing rotation of the pulley, and rotation of pulley being controlled by rotation of the flywheel so as to control the downward running speed of the stairs.

Preferably, the resistance mechanism has another electromagnet disposed next to the flywheel and opposite to the electromagnet which is coupled to the brake unit.

There are several advantages of the stair exerciser apparatus of the present invention. The brake unit of the electromagnetic resistance device regards as a safety mechanism used when there is no power or loss of power so as to prevent the stairs from moving when the brake block is engaged with the flywheel. The brake unit is designed as an emergency stop brake to stop stairs by itself in case the power of the stair exerciser apparatus is lost.

Further benefits and advantages of the present invention will become apparent after a careful reading of the detailed description with appropriate reference to the accompanying drawings.

DETAIL DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
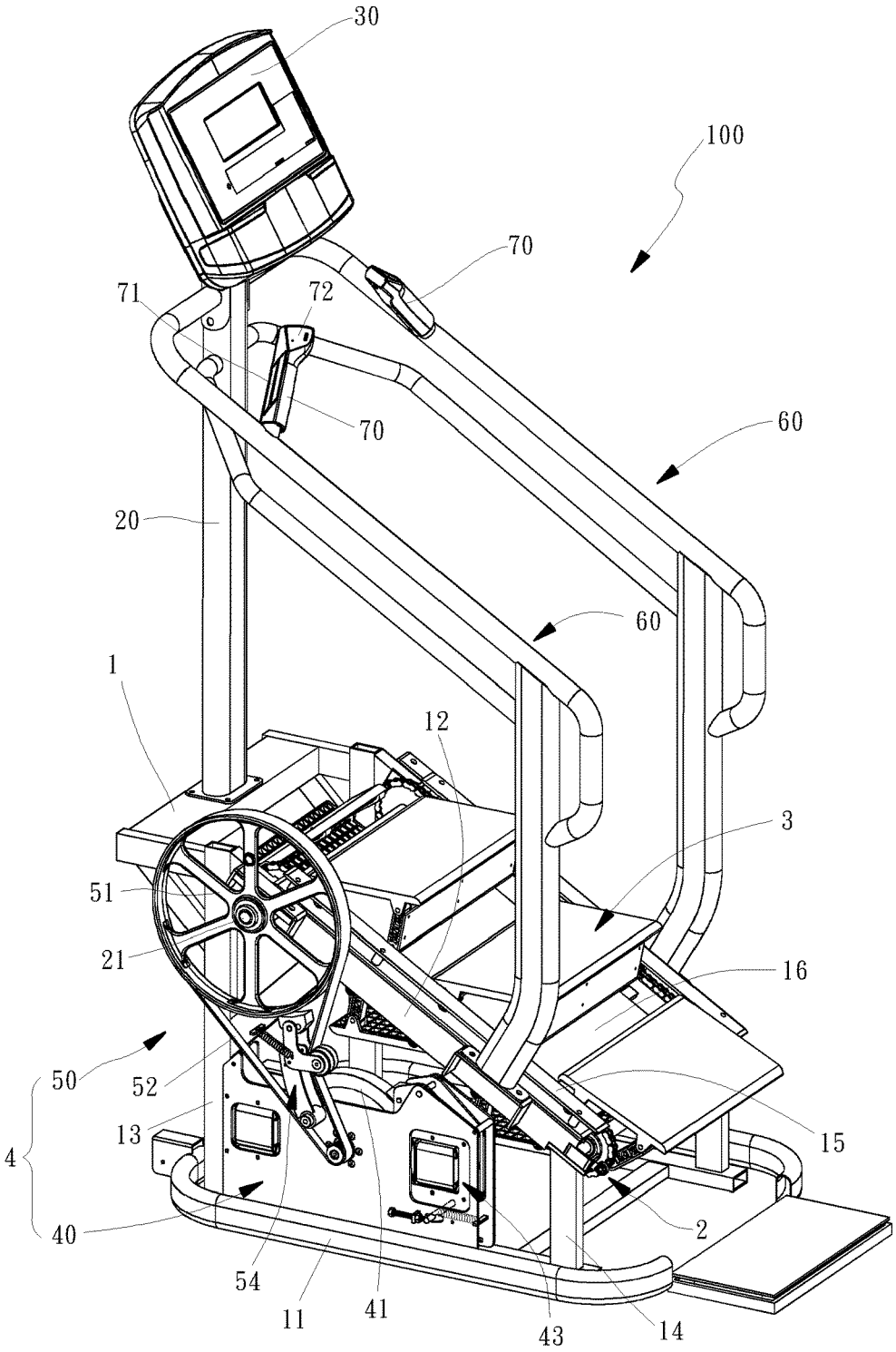
FIG. 1 is a perspective view of a stair exerciser apparatus in accordance with a preferred embodiment of the present invention.
Figure 2:
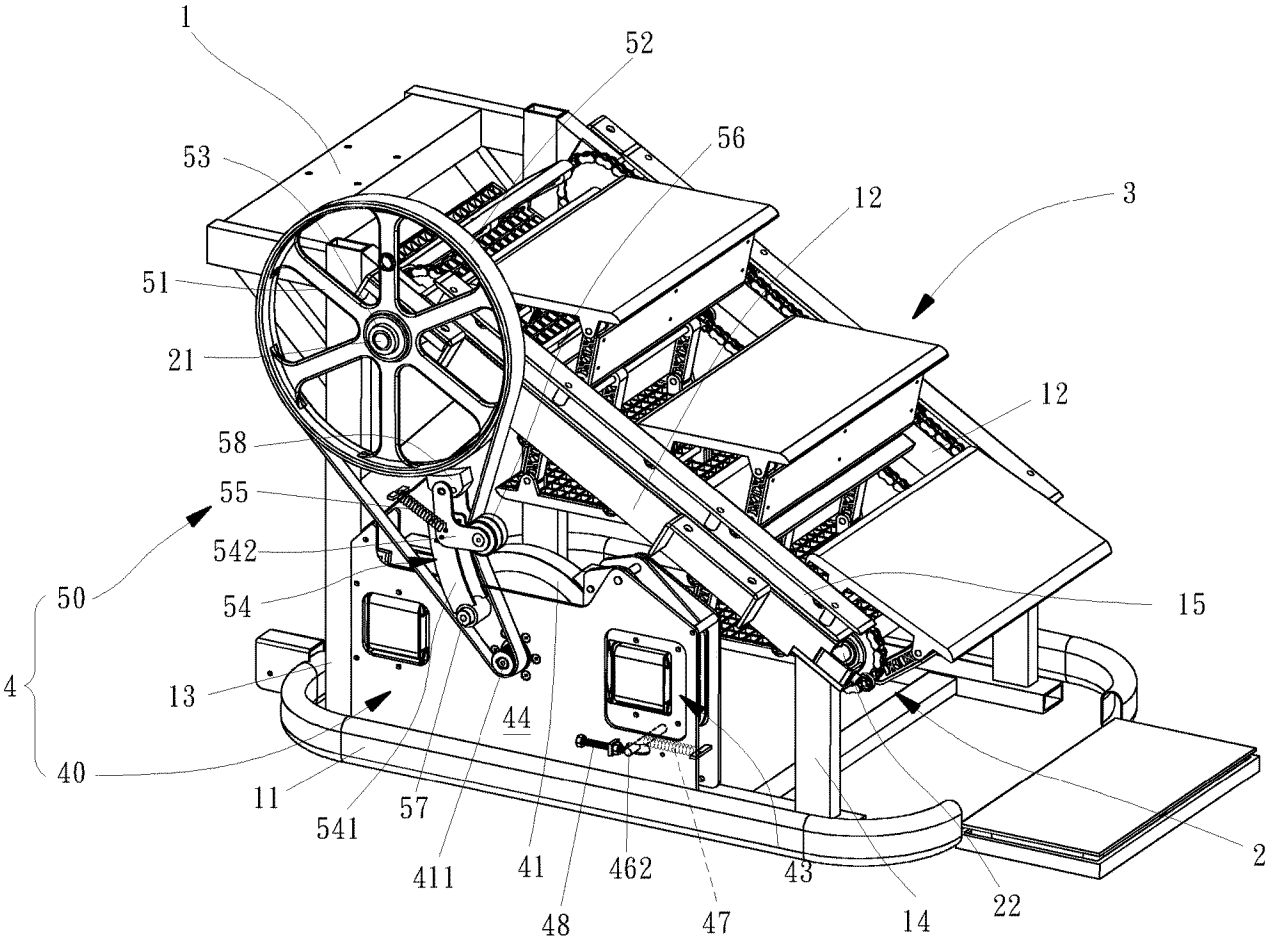
FIG. 2 is a lower assembly of the stair exerciser apparatus shown in FIG. 1.
Figure 3:
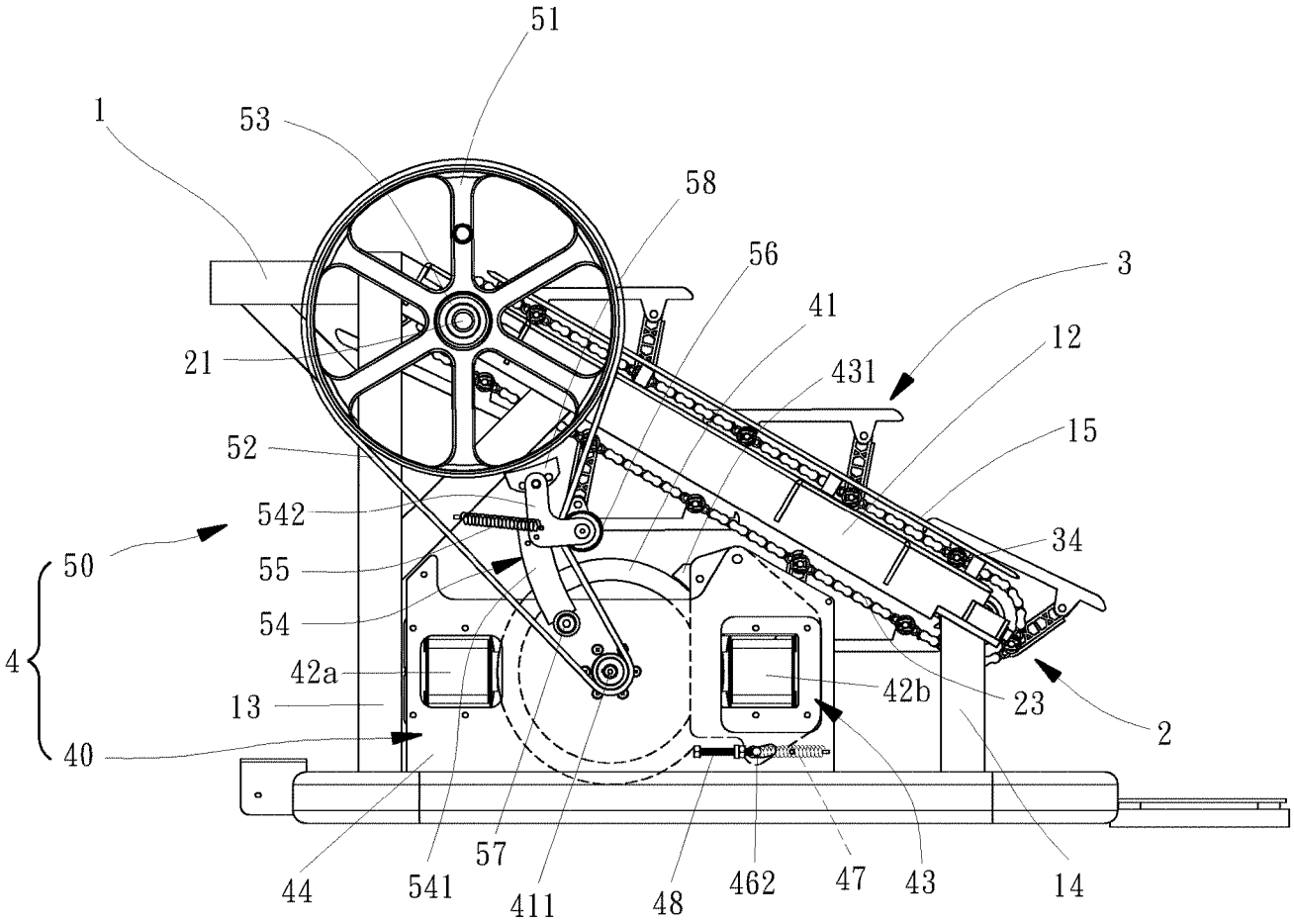
FIG. 3 is a side view of FIG. 2.

Referring to FIG. 1 through FIG. 3, a preferred embodiment of a stair exerciser apparatus 100 for simulating stair climbing is illustrated below. The stair exerciser apparatus 100 includes a lower assembly which includes a frame 1, a drive mechanism 2, a plurality of stairs 3 and a resistance mechanism 4. The frame 1 has a base 11 resting on a substantially horizontal support surface such as a floor and a pair of inclined supports 12 slanted downward from a front end of the frame 1 to a rear end of the frame 1. The base 11 of the frame 1 is substantially U-shaped with an open end toward the rear of the stair exerciser apparatus 100. The pair of inclined supports 12 are disposed at two opposite sides of the frame 1 for supporting the drive mechanism 2 and the stairs 3. Each inclined support 12 is supported by a front post 13 and a rear post 14. The front post 13 and the rear post 14 are mounted upright on the base 11 and the length of the front post 13 is longer than the length of the rear post 14 such that each inclined support 12 is inclined from the front end of the frame 1 to the rear end of the frame 1.

As shown in FIG. 1, the stair exerciser apparatus 100 includes a console mast 20 for supporting a console 30 at the front side thereof, two handrails 60 defined at opposite sides of the stair exerciser apparatus 100 and two grip members 70 respectively mounted to the two handrails 60. The console mast 20 is mounted upright on a top plane of the frame 1. The console 30 includes a display screen enable to provide feedback to an operator. The two handrails 60 are mounted to the respective inclined supports 12 of the frame 1 for allowing a user to hold while he/she walks up or down the stairs 3, and an entrance is defined between the two handrails 60 at the rear side of the stair exerciser apparatus 100 so that the user could enter or exit from stair exerciser apparatus 100. Each grip member 70 has a heart rate monitor 71 build into the grip member 70. In the preferred embodiment, each grip member 70 has control buttons 72 incorporated into the grip member 70. The control buttons 72 on each grip member 70 can include controls such as speed control, resistance control, start, stop, and pause.

Figure 6:
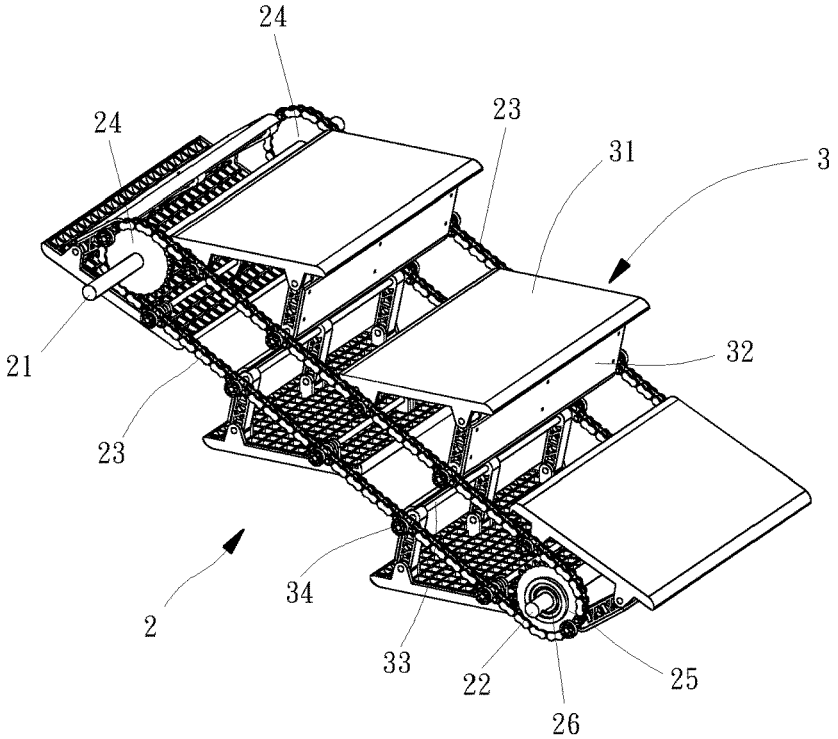
FIG. 6 is a perspective view of the drive mechanism with a plurality of stairs.

As shown in FIG. 2 and referring to FIG. 6, the drive mechanism 2 has an upper shaft 21 rotatably mounted to the frame 1 at an upper portion of the pair of inclined supports 12 and a lower shaft 22 rotatably mounted to the frame 1 at a lower portion of the pair of inclined supports 12. In the preferred embodiment, a pair of drive chains 23 which are mounted around the upper shaft 21 and the lower shaft 22 at opposite sides for revolving circularly around the pair of inclined supports 12. The plurality of stairs 3 are coupled to the pair of drive chains 23 for being synchronously revolved round the pair of inclined supports 12. Therefore, the stairs 3 could be movable along the pair of inclined supports 12. Specifically, the stairs 3 are disposed circularly along the pair of drive chains 23. In the preferred embodiment as depicted in FIG. 6, the stairs 3 are spaced apart along the pair of drive chains 23, and every adjacent two of the stairs 3 are spaced apart in a distance. However, in another embodiment, the stairs could be connected together in series around the inclined supports, which is not limited by the present invention.

Referring to FIG. 2 to FIG. 3, the resistance mechanism 4 is coupled to the drive mechanism 2 for synchronizing the rotational motion of the stairs 21. The resistance mechanism 4 is configured to adjust and control the rotational resistance of the upper shaft 21 or the lower shaft 22 so as to adjust and control the downward running speed of the stairs 3. In the preferred embodiment of the present invention, the resistance mechanism 4 is coupled the upper shaft 21 of the drive mechanism 2. The resistance mechanism 4 includes an electromagnetic resistance device 40 and a pulley assembly 50. The pulley assembly 50 has a pulley 51 coupled to the upper shaft 21 and a belt 52 connecting the pulley 51 and the electromagnetic resistance device 40 for synchronizing the motion of the pulley 51 and the motion of the electromagnetic resistance device 40. Therefore, the rotational resistance of the pulley 51 could be adjusted and controlled by the electromagnetic resistance device 40 so as to adjust and control the downward running speed of the stairs 3.

Figure 4:
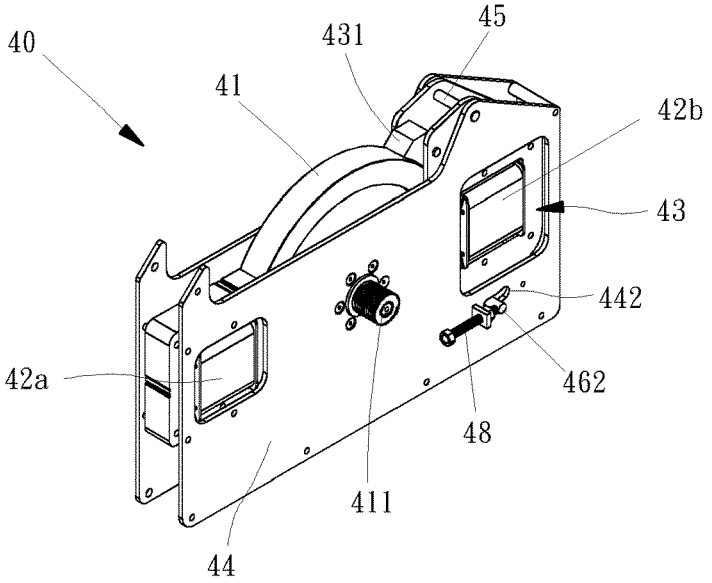
FIG. 4 is a perspective view of the electromagnetic device
Figure 5:
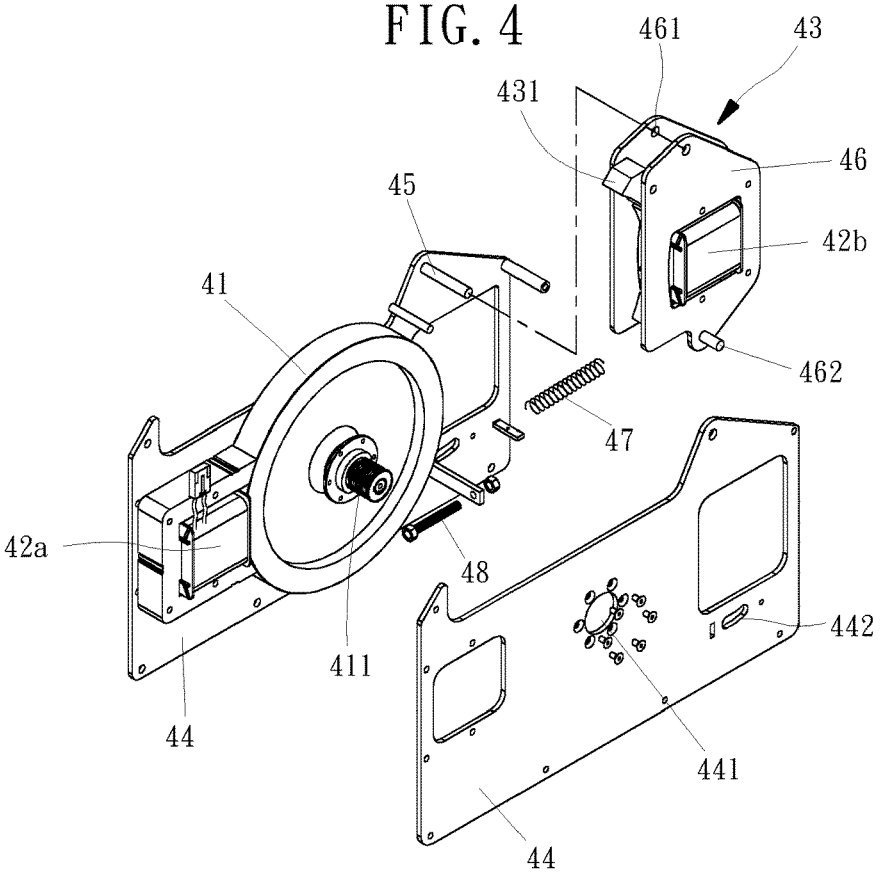
FIG. 5 is an exploded perspective view of the electromagnetic device shown in FIG. 4.

Referring to FIG. 4 and FIG. 5, in the preferred embodiment of the present invention, the electromagnetic resistance device 40 is an electromagnetic brake system such as an eddy current brake (ECB) which includes a flywheel 41, a first electromagnet 42*a* and a second electromagnet 42*b* respectively disposed at two opposite sides of the flywheel 41 and corresponding to an outer periphery of the flywheel 41 for electrically controlling the rotational resistance of the flywheel 41. Rotation of the pulley 51 rotates the belt 52 that is connected to and rotates the flywheel 41 about a central shaft 411. As shown in FIG. 2, the belt 52 is mounted around the pulley 51 and the central shaft 411 of the flywheel 41 for transmitting the motion between them. The two electromagnetics 42*a*, 42*b* provide a drag force to stop or slow down rotation of the flywheel 41 so as to control the downward running speed of the stairs 3. Specifically, the electromagnetic resistance device 40 further includes a brake unit 43 which could be coupled with one of the two electromagnets 42*a*, 42*b*. As shown in FIG. 4, the first electromagnet 42*a* is fixed next the flywheel 41 and the second electromagnet 42*b* is coupled together with the brake unit 43 so that the second electromagnet 42*b* and the brake unit 43 could be movable simultaneously with respect to the flywheel 41. Also, the brake unit 43 has a brake block 431 configured to stop rotation of the flywheel so as to stop the stairs 3. Under this arrangement, the brake unit 43 is movable between a non-braking position where the brake block 431 is pulled away from the flywheel 41 when the electromagnetic resistance device 40 is energized and a braking position where the brake block 431 is pulled to brake the flywheel 41 when the electromagnetic resistance device 40 is loss of power.

As shown in FIG. 4, FIG. 5 and referring to FIG. 2, the electromagnetic resistance device 40 has a support frame including two spaced apart retaining plates 44 secured to the base 11 of the frame 1 for retaining the flywheel 41. The two retaining plates 44 are arranged opposite to each other to define an inner space for receiving the flywheel 41, the two electromagnets 42*a*, 42*b* and the brake unit 43. The Flywheel 41 is sandwiched between the two retaining plates 44. The central shaft 411 of the flywheel 41 passes through an opening 441 of each of the two retaining plates 44 such that the flywheel 41 is supported by the two retaining plates 44 and rotatable within the two retaining plates 44. In the preferred embodiment, the first electromagnet 42*a* is secured in between the two retaining plates 44 at one side of the flywheel 41, as depicted in FIG. 5. The brake unit 43 is pivotally connected between the two retaining plates 44 via a pivot pin 45. The pivot pin 45 is fixed between the two retaining plates 44 for allowing the brake unit 43 to be pivoted on the pivot pin 45. In this manner, the brake unit 43 could be swingable relative to the outer periphery of the flywheel 41 to push the brake block 431 to contact with the outer periphery of the flywheel 41 or pull the brake unit 431 away from the outer periphery of the flywheel 41.

Referring to FIG. 5, the brake unit 43 has two side plates 46 spaced a distance apart. The second electromagnet 42*b* is sandwiched in between the two side plates 46. The brake block 431 is pivotally mounted between the two side plates 46 at the upper portion of the brake unit 43 toward the outer periphery of the flywheel 41. Each side plate 46 has a pivot hole 461 defined at the upper portion thereof. The pivot pin 45 passes through the pivot hole 461 of each side plate 46 and secured to the two retaining plates 44 so that the brake unit 43 could swing about the pivot pin 45. Since the second electromagnet 42*b* is coupled with the brake unit 43, the brake unit 43 and the second electromagnet 42*b* can be moved together. In the preferred embodiment of the present invention, the flywheel 41 has magnetic property, for example, the flywheel may be a magnetic substance or integrated with magnetic substances. When the electromagnetic resistance device 40 is powered, the two electromagnets 42*a*, 42*b* are energized simultaneously, and the second electromagnet 42*b* would slightly move forward to approach the outer periphery of the flywheel 41 by the magnetic attraction between them. As the second electromagnet 42*b* energized to approach to flywheel 41, the brake unit 43 would move forward simultaneously to the non-braking position to pull the brake block 431 away from the flywheel 41 for allowing the flywheel 41 to rotate freely. In contrast, once power is lost, the brake unit 43 would be pulled backward to the braking position in which the brake block 431 is driven to stop rotation of the flywheel 41.

In the preferred embodiment of the present invention, the brake unit 43 is generally pulled backward by a spring 47 as no power or loss of power. As shown in FIG. 5, the brake unit 43 has a post 462 extending through the two side plates 46 at the lower portion of the brake unit 43. The spring 47 has one end secured to the post 462 and the other end anchored to the two retaining plates 44 via any fixing member. The spring 47 is configured to bias the brake unit 43 pivotally backward to the braking position to push the brake block 431 into the flywheel 41 for stopping revolution of the stairs 3. Specifically, each retaining plate 44 has a slot 442 corresponding to the post 462 of the brake unit 43. As shown in FIG. 4 and referring to FIG. 2, the post 462 is projected from each retaining plate 44 via the slot 442, and the post 462 could be moved forward to the non-braking position or backward to the braking position within the slot 442 to restrict the rotation angle of the brake unit 43. Additionally, a gap between the second electromagnet 42*b* and the flywheel 41 could be adjusted by an adjusting screw 48 which is mounted to a tab protruded from the respective retaining plate 44. The adjusting screw 48 is configured to retain the forward motion of the post 462 so as to restrict the gap between the second electromagnet 42*b* and the flywheel 41.

Referring to FIG. 1 through FIG. 3, the electromagnetic resistance device 40 is mounted to the frame 1 and controlled by a controller (not shown). The electromagnetic resistance device 40 is adjustable so that the amount of resistance or braking force may be increased or decreased by the controller. The flywheel 41 is connected by the belt 52 and the pulley 51 to the upper shaft 21. As the stairs 3 of the stair exerciser apparatus 100 are driven downward by an external load such as the weight of an operator standing upon one or more of the stairs 3, the drive chains 23 revolve about the upper shaft 21 and the lower shaft 22, causing the upper shaft 21 to rotate. Rotation of the upper shaft 21 drives rotation of the pulley 51. As the pulley 51 rotates, the electromagnetic resistance device 40 provides an opposing torque to the pulley 51, thereby slowing down rotation of the pulley 51 and the speed of the stairs 3.

The brake unit 43 of the electromagnetic resistance device 40 is a safety mechanism used when there is no power or loss of power so as to prevent the stairs 3 from moving as the brake block 431 is engaged with the flywheel 41. The brake unit 43 is designed as an emergency stop brake to stop stairs 3 by itself in case the power of the stair exerciser apparatus 100 is lost. Since the resistance applied to the flywheel 41 may be lost suddenly, causing the stairs 3 to revolve with no resistance, it is dangerous for people to use. In order to prevent the user from falling from the stairs 3 of the stair exerciser apparatus 100, the safety mechanism is necessary. Additionally, a locking mechanism (not shown) may be coupled to the upper shaft 21. When the stairs 3 are stationary, the locking mechanism is engaged by the controller to ensure the stairs 3 remain stationary.

Referring to FIG. 2 to FIG. 3, the pulley 51 is connected to the upper shaft 21 by a clutch 53. In the preferred embodiment of the present invention, the clutch 53 is a one way clutch or a uni-directional clutch, which would transmit torque in one direction and freewheel in the opposite direction. The clutch 53 allows the upper shaft 32 to engage the pulley 51 to rotate in a rotational direction and to disengage the pulley 51 in an opposite direction. The clutch 53 is configured to engage the pulley 51 in a clutched rotational direction and freewheel in an unclutched rotation direction. For example, when the stairs 3 are driven downward by the user, the upper shaft 21 is rotated in a clockwise direction in accord with the revolution of the stairs 3 and drives the pulley 51 by the clutch 53 to rotate in the same direction. Rotation of the pulley 51 drives the flywheel 41 to rotate via the belt 52. The flywheel 41 of the electromagnetic resistance device 40 coupled with the pulley 51 to provide opposite torque to the upper shaft 21 so as to slow down the downward running speed of the stairs 3. Therefore, the downward running speed of the stairs 3 could be controlled by the resistance mechanism 4. Since the pulley 51 and the flywheel 41 have rotational inertia, they keep the stairs 3 moving smoothly. The operation between the pulley 51 and the upper shaft 21 is described below. If the stairs 3 or drive mechanism 2 got stuck or rotated abnormally opposite to the rotational direction of the pulley 51 due to an object in the path of the stairs 3, the clutch 53 on the pulley 51 would prevent the pulley's rotational inertia from creating torque against the object in the path of the stairs 3, namely, the pulley 51 will be idling while the upper shaft 21 gets stuck. In this manner, when some accidents occur such as a user's foot get stuck in between the stairs 3, the clutch 53 would be unclutched the pulley 51 to prevent the torque of the pulley 51 from being exerting to the upper shaft 21 for safety. In another embodiment, the pulley may be regarded as a flywheel, and a braking mechanism provides an opposing torque to the flywheel, thereby slowing down rotation of the flywheel and the speed of the stairs. The braking mechanism may be an eddy current brake, a friction brake, or any other brake that is known in the art.

As shown in FIG. 3 and FIG. 4, a pulley brake 54 is configured to stop the pulley 51 in order to prevent the belt 52 from being broken or loosened. A spring 55 which pulls the pulley brake 54 into the pulley 51. In the preferred embodiment of the present invention, the belt 52 is tensioned by the spring 55 that biases an idler roller 56 about a pivot point 57. The spring 55 has one end secured to the frame 1 and the other end secured to the pulley brake 54. The pulley brake 54 is pivotable about the pivot point 57 and biased by the spring 55. The pulley brake 54 has a brake block 58 pivotally mounted at one end of the pulley brake 54 opposite to the pivot point 57. The idler roller 56 is mounted to the pulley brake 54 and against the belt 52. The pulley brake 54 is pulled away from the pulley 51 by the tension of the belt 52 against the elastic force of the spring 55. If the belt 52 were broken or loosened, the tension of the belt would be disappeared or decreased, and thereby the pulley brake 54 is pulled into the pulley 51 by the spring 55 to stop the pulley 51 for safety.

In the preferred embodiment of the present invention, the pulley brake 54 has a first arm 541 and a second arm 542 connected with each other. The first arm 541 is pivotally connected to the corresponding retaining plate 44 of the electromagnetic resistance device 40 at the pivot point 57. The second arm 542 is substantially V-shaped with two legs. The apex of the second arm 542 is connected to the first arm 541 at one end opposite to the pivot point 57. The second arm 542 may be pivotable with respect to the first arm 542, which is not limited by the present invention. The idler roller 56 is rotatably mounted to one leg of the second arm 542, and the brake block 58 is pivotally mounted to the other leg of the second arm 542, as shown in FIG. 3. The two legs of the second arm 542 may be perpendicular to one another. The belt 52 from the pulley 51 is configured to drive the electromagnetic resistance device 40 such as ECB brake. Since rotation of the pulley 51 is controlled by the electromagnetic resistance device 40, if the belt 52 were broken, the pulley 51 would run without any resistance, causing the stairs 3 to revolve out of control. In order to prevent the situation, the pulley brake 54 regards as an emergency brake to prevent the belt 52 from being broken. However, in another embodiment, the pulley brake 54 may be secured on the frame 1 (not shown). The pulley brake 54 may be substantially fork-shaped with two legs respectively connected to the idler roller 56 and the brake block 58.

Figure 7:
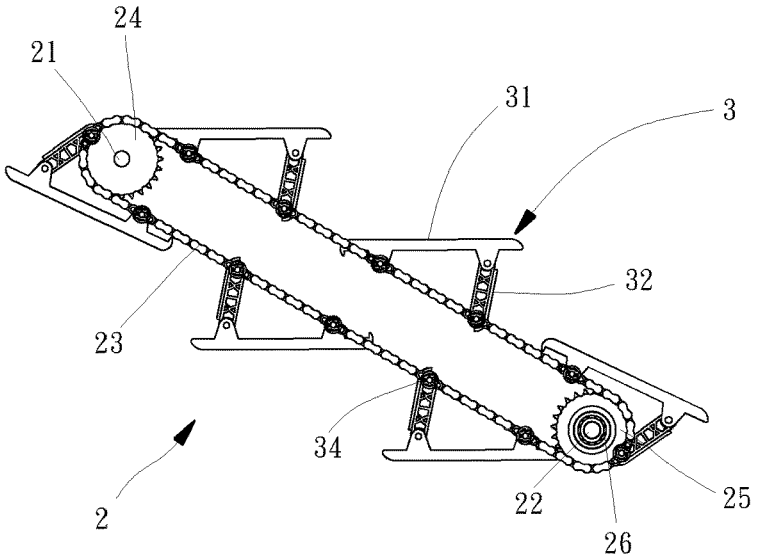
FIG. 7 is a side view of FIG. 6.

Referring to FIG. 6 and FIG. 7, the drive mechanism 2 is shown more clearly. The upper shaft 21 is connected to a pair of upper sprockets 24, and the lower shaft 22 is connected to a pair of lower sprockets 25. Each of the drive chains 23 is mounted around the respective upper sprocket 24 and the respective lower sprocket 25. In the preferred embodiment of the present invention, the upper shaft 21 is supported by the frame 1 and connected to the pulley 51, as shown in FIG. 2. The lower shaft 22 is supported by the frame 1 at the rear end. There is a bearing 26 mounted in between the lower shaft 22 and each lower sprocket 25, so that each lower sprocket 25 could be rotatable about the lower shaft 22 smoothly, as shown in FIG. 6. As the weight of the user standing upon the stairs 3, the drive chains 23 revolve the upper sprockets 24 and the lower sprockets 25, causing the upper shaft 21 to rotate. Rotation of the upper shaft 21 causes rotation of the pulley 51 and rotation of the flywheel 41. Under this arrangement, the rotational resistance of the flywheel 41 could be controlled to adjust the downward running speed of the stairs 3.

Referring to FIG. 6 through FIG. 9, each of the stairs 3 consists of a tread 31 and a riser 32. The tread 31 and the riser 32 are pivotally snapped together such that the tread 31 could break away from the riser 32 if any object were to be placed in the path of the stairs 3. The tread 31 has a tread surface for supporting a user's foot as the user steps onto the stair 3. Each stair 3 is connected to the pair of drive chains 23 by two pivot shafts 33. One of the two pivot shaft 33 connects the tread 31 to the drive chains 23, and the other one connects the riser 32 to the drive chains 23. As shown in FIG. 6 and referring to FIG. 8, each pivot shaft 33 has two ends pivotally connected to the pair of the drive chains 23. The pair of drive chains 23 supports the stairs 3 such that the stairs 3 could be revolved along with rotation of the pair of drive chains 23 around the upper shaft 21 and the lower shaft 22. Besides, each pivot shaft 33 is attached with two bearing 34 at two opposite ends. Each inclined support 12 has a guide track 15 attached thereon for supporting each pivot shaft 33. Additionally, each bearing 34 is configured to move along the guide track 15 that extending along the corresponding inclined support 12 from the front end to the rear end of the frame 1 for guiding the pivot shafts 33 of the respective stairs 3 at the upper run of the corresponding drive chain 23 move downward and backward along the guide track 15, as shown in FIG. 3, such that the stairs 3 could travel around the inclined supports 12.

Figure 8:
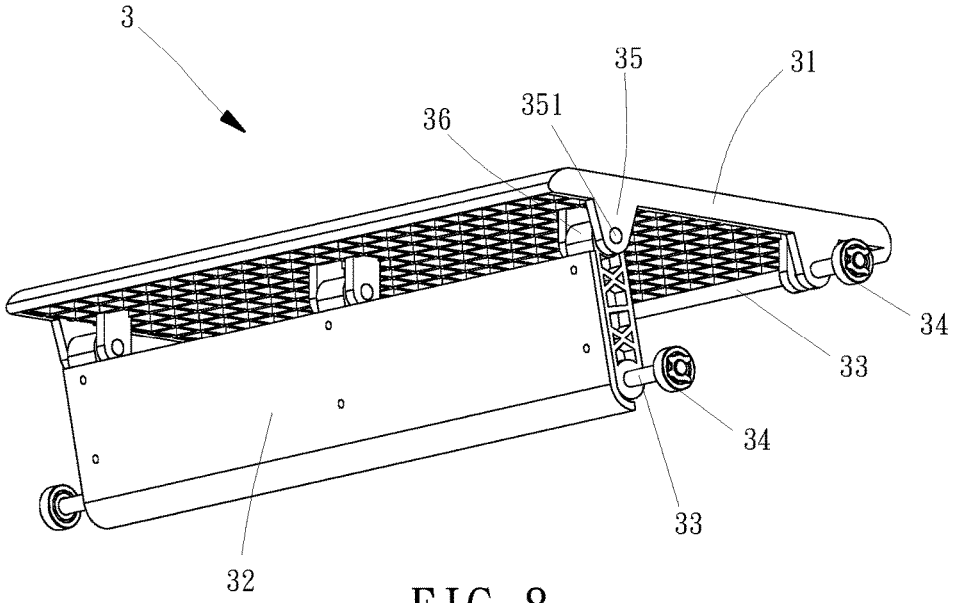
FIG. 8 is a perspective view of each stair showing that the tread and the riser are snapped together.
Figure 9:
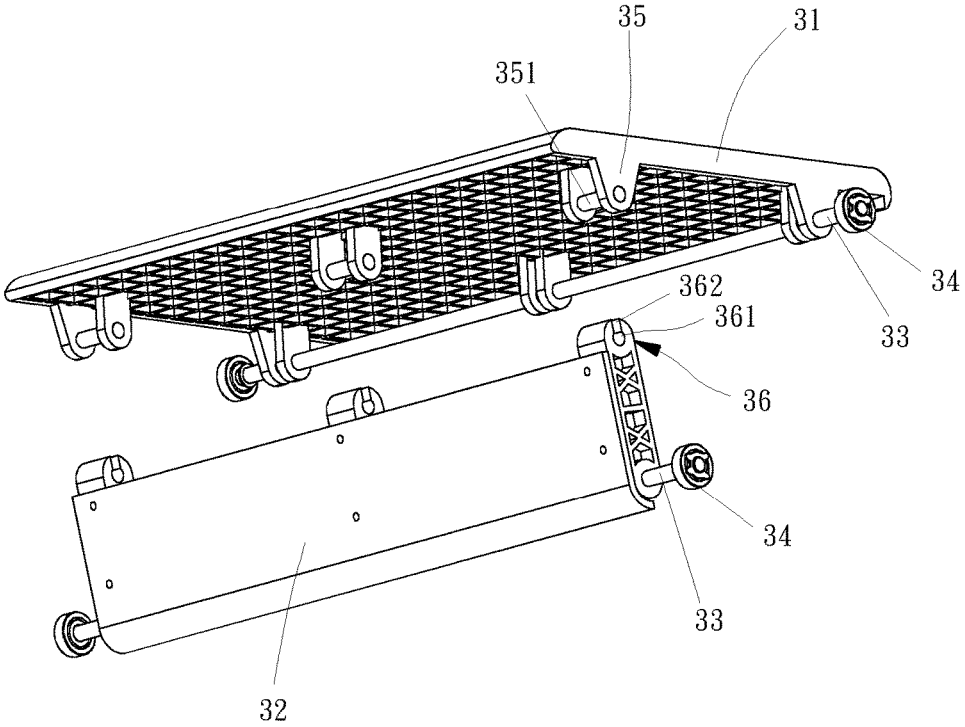
FIG. 9 illustrates the tread breaking away from the riser.

Referring to FIG. 8 to FIG. 9, the tread 31 has one or a plurality of connecting parts 35 disposed at a bottom the tread 31 at the junction of the tread 31 and the riser 32, and the riser 32 has one or a plurality of clipping members 36 corresponding to the respective connecting parts 35 of the tread 31. Each connecting part 35 has a connecting pin 351 laterally defined therein. Each clipping member 35 is configured to snap the connecting pin 351 of the connecting part 35. Specifically, each clipping member 35 has an aperture 361 for receiving the connecting pin 351 of the corresponding connecting part 35 and an opening 362 in communication with the aperture 361. The opening 362 has a width slightly smaller than a diameter of the aperture 362 such that the connecting ping 351 could be clipped by an inner wall of the aperture 361 of the respective clipping member 36. In this manner, the connecting ping 351 of each connecting part 35 could be pivotally positioned in the aperture 361 of the corresponding clipping member 36 and be detached from the aperture 361 of the corresponding clipping member 36 via the opening 362. Under this arrangement, the tread 31 and the riser 32 are pivotally snapped together, so that the tread 31 could break away from the riser 32 if any object were to be placed in the path of the stairs 3. For example, if a user's foot were to get stuck in between the stairs 3, the tread 31 could be detached from the riser 32 immediately so as to avoid any injury to the user. Additionally, as shown in FIG. 1, a baffle board 16 may be disposed under the stairs 3 and arranged parallel to the pair of the inclined supports 12 for preventing an object from being fallen into the drive mechanism 2.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electromagnetic resistance device applied to an exercise apparatus, the exercise apparatus having a frame and a drive mechanism, the electromagnetic resistance device coupled to the drive mechanism for slowing or stopping rotational movement of the drive mechanism of the exercise apparatus, the electromagnetic resistance device comprising:

a support frame secured to the frame of the exercise apparatus;

a flywheel rotatable with respect to the support frame for controlling the rotational movement of the drive mechanism of the exercise apparatus;

an electromagnet movably arranged next to the flywheel for electronically controlling rotational resistance of the flywheel;

a brake unit pivotally mounted to the support frame, and having a brake block for stopping rotation of the flywheel, the brake unit coupled with the electromagnet for being simultaneously movable between a non-braking position where the brake block is pulled away from the flywheel when the electromagnet is energized and a braking position where the brake block is pulled to brake the flywheel when the electromagnet is loss of power.

2. The electromagnetic resistance device as claimed in claim 1, wherein the brake unit is moved forward to the non-braking position by magnetic attraction between the electromagnet and the flywheel.

3. The electromagnetic resistance device as claimed in claim 1, wherein the electromagnetic resistance device has a spring connected between the support frame and the brake unit for normally biasing the brake unit backward to the braking position.

4. The electromagnetic resistance device as claimed in claim 3, wherein support frame of the electromagnetic resistance device has two spaced apart retaining plates, the flywheel being rotatably sandwiched between the two opposite retaining plates, the brake unit being pivotally mounted about a pivot pin connected between the two retaining plates such that the brake unit is pivotally rotatable between the non-braking position and the braking position.

5. The electromagnetic resistance device as claimed in claim 4, wherein the brake unit has a post defined at a lower portion opposite to the pivot pin, the spring having one end secured to the post and the other end anchored to the two retaining plates for pulling the brake unit backward to the braking position.

6. The electromagnetic resistance device as claimed in claim 5, wherein at least one of the retaining plates has a slot for receiving the post of the brake unit to restrict a rotation angle of the brake unit between the non-braking position and the braking position.

7. The electromagnetic resistance device as claimed in claim 6, further comprising a screw secured to a tab which is protruded from the corresponding retaining plate to retain the post projected from the corresponding retaining plate through slot for restricting a gap between the electromagnet and the flywheel.

8. The electromagnetic resistance device as claimed in claim 5, wherein the brake unit has two side plates spaced a distance apart, the electromagnet is sandwiched in between the two side plates, the brake block pivotally mounted between the two side plates at an upper portion of the brake unit toward the flywheel, and the post extending through the two side plates at a lower portion of the brake unit opposite to the pivot pin.

9. The electromagnetic resistance device as claimed in claim 1, wherein the resistance mechanism has another electromagnet disposed next to the flywheel and opposite to the electromagnet which is coupled to the brake unit.

10. An exerciser apparatus, comprising:

a frame;

a drive mechanism mounted on the frame;

an electromagnetic resistance device coupled to the drive mechanism for slowing or stopping rotational movement of the drive mechanism of the exercise apparatus, the electromagnetic resistance device having a support frame secured to the frame of the exercise apparatus, a flywheel rotatable with respect to the support frame for controlling the rotational movement of the drive mechanism of the exercise apparatus, an electromagnet movably arranged next to the flywheel for electronically controlling rotational resistance of the flywheel, and a brake unit pivotally mounted to the support frame, the brake unit having a brake block for braking rotation of the flywheel, the brake unit coupled with the electromagnet for being simultaneously movable between a non-braking position where the brake block is pulled away from the flywheel when the electromagnet is energized and a braking position where the brake block is pulled to brake the flywheel when the electromagnet is loss of power.

* * * * *